US005238522A

United States Patent [19]

Sakano et al.

[11] Patent Number: 5,238,522

[45] Date of Patent: Aug. 24, 1993

[54] JOINING DEVICE FOR STRIP-LIKE MATERIAL

[75] Inventors: Makoto Sakano; Yoshihisa Sato, both of Tokyo, Japan

[73] Assignee: Japan Tobacco Inc., Tokyo, Japan

[21] Appl. No.: 887,656

[22] Filed: May 26, 1992

Related U.S. Application Data

[63] Continuation of Ser. No. 513,768, Apr. 24, 1990, abandoned.

[30] Foreign Application Priority Data

Apr. 26, 1989 [JP] Japan ..... 1-104627

[51] Int. Cl.[5] ..... B65H 21/00

[52] U.S. Cl. ..... 156/502; 156/157; 156/304.3; 156/364; 156/504; 156/506; 156/519; 156/520

[58] Field of Search ..... 156/520, 504, 505, 506, 156/304.3, 364, 541, 157, 511, 518, 519, 520

[56] References Cited

U.S. PATENT DOCUMENTS

| | | | |
|---|---|---|---|
| 4,067,760 | 1/1978 | Nelson | 156/505 X |
| 4,385,959 | 5/1983 | Goguen | 156/506 |
| 4,636,279 | 1/1987 | Morgan | 156/506 |
| 4,812,198 | 3/1989 | Fuke et al. | 156/505 X |
| 4,878,982 | 11/1989 | Ogata et al. | 156/505 X |
| 4,925,520 | 5/1990 | Beaudoin et al. | 156/519 X |

FOREIGN PATENT DOCUMENTS

| | | |
|---|---|---|
| 0273286 | 7/1988 | European Pat. Off. . |
| 0273287 | 7/1988 | European Pat. Off. . |
| 3150648A1 | 8/1982 | Fed. Rep. of Germany . |
| 3227838A1 | 3/1983 | Fed. Rep. of Germany . |

*Primary Examiner*—James J. Engel, Jr.
*Attorney, Agent, or Firm*—Nixon & Vanderhye

[57] ABSTRACT

A device for joining a leading end of a new second strip-like material to a trailing end of a supplied first strip-like material is disclosed. This device includes a joining preparation path. A stamper base is arranged midway along the joining preparation path. The first and second strip-like materials are fed to the joining preparation path by first and second feed mechanisms, respectively. The first strip-like material passes through the stamper base, and is supplied to the next process by a convey mechanism. The leading end of the second strip-like material is aligned with a predetermined position of the stamper base, and is held in position. The device includes a stamper for holding a joining tape piece by suction. When the trailing end of the first strip-like material reaches the predetermined position of the stamper base, the stamper is driven toward the stamper base, and the trailing end of the first strip-like material is joined to the leading end of the second strip-like material by the joining tape piece.

2 Claims, 5 Drawing Sheets

JOINING DEVICE FOR STRIP-LIKE MATERIAL

This is a continuation of application Ser. No. 07/513,768, filed Apr. 24, 1990, now abandoned.

BACKGROUND OF THE INVENTION

1. Field of the Invention

The present invention relates to a device, used in an apparatus for alternately unrolling and supplying strip-like materials, e.g., strip-like wrapping papers for wrapping cigarettes from at least two rolls without interrupting supply of the strip-like materials, for, when a strip-like material unrolled and supplied from one roll is used up, joining the leading end of a new strip-like material unrolled from the other roll to the trailing end of the supplied strip-like material.

2. Description of the Related Art

As a conventional device of this type, a joining device disclosed in Published Unexamined Japanese Patent Application No. 63-162434 is known. This joining device overlays a leading end portion of a new wrapping material unrolled from the other roll on a trailing end portion of a strip-like wrapping material unrolled and supplied from one roll, and joins the trailing and leading end portions of these wrapping materials by a joining tape. However, in the conventional joining device, since the trailing and leading end portions of the wrapping materials are joined while they overlap each other, the overlapping portion may cause troubles in the following wrapping process or the like. In this joining device, a joining tape must be supplied to both the trailing end portion of the already supplied wrapping material, and the leading end portion of a new wrapping material, resulting in a complicated supply mechanism of a joining tape. The complicated mechanism also impairs reliability of an operation.

SUMMARY OF THE INVENTION

The present invention has been made to eliminate the drawbacks of the conventional joining device, and has as its object to provide a device which mates the leading end of a new strip-like material to the trailing end of the already supplied strip-like material, and joins the trailing and leading end portions of these strip-like materials by a joining tape in this state. It is another object of the present invention to provide a joining device which has a simple structure, and can improve reliability of an operation.

The objects of the present invention can be attained by the following characteristic features of the present invention.

The joining device of the present invention comprises a joining preparation path for conveying a strip-like material. A stamper base is arranged midway along the joining preparation path. A first guide path is connected to an upstream end portion of the joining preparation path. A first strip-like material unrolled from a first roll is fed to the joining preparation path through the first guide path. A second guide path is connected to the middle portion of the joining preparation path on the upstream side of the stamper base. A second strip-like material unrolled from a second roll is fed to the joining preparation path through the second guide path.

First and second feed mechanisms are arranged in correspondence with the first and second guide paths. A convey mechanism is arranged on a downstream end portion of the joining preparation path. The first strip-like material is continuously supplied to a device for executing the next process through the stamper base by the first feed mechanism and the convey mechanism. The second strip-like material is fed to a portion of the stamper base by the second feed mechanism, and stands by in a state wherein its leading end is aligned with a predetermined position of the stamper base.

The joining device comprises a stamper. The stamper has a suction surface capable of holding a joining tape by suction. The joining device comprises a joining tape supply mechanism which supplies a joining tape to the suction surface of the stamper. The joining device comprises a cutter mechanism for cutting the joining tape by a predetermined length. The cut joining tape piece is held on the suction surface of the stamper by suction. The stamper is pivoted through about 90°, so that the suction surface which holds the joining tape piece by suction opposes a predetermined position of the stamper base. The joining device also comprises a stamper driving mechanism for driving the stamper toward the stamper base.

The joining device is supplied with the first strip-like material, i.e., the already supplied strip-like material through the joining preparation path and the stamper base. On the other hand, the second strip-like material stands by in a state wherein its leading end is aligned with the predetermined position of the stamper base. When the trailing end of the first strip-like material reaches the position of the stamper base, the stamper is operated to join the trailing end of the first strip-like material with the leading end of the standby second strip-like material by a joining tape. The second strip-like material is then supplied to be continuous with the first strip-like material.

According to the joining device described above, the trailing end of the first strip-like material and the leading end of the second strip-like material are joined by a joining tape while mating them with each other. Therefore, the joined portion of the first and second strip-like materials will not cause a trouble in the following wrapping process or the like. Only one joining tape is needed, and hence, a structure such as a joining tape supply mechanism can be simplified. As a result, reliability of an operation of the device can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

A joining device according to an embodiment of the present invention will now be described with reference to the accompanying drawings. The joining device of this embodiment is a device for joining the trailing end of a strip-like wrapping material for forming a package of cigarettes to the leading end of a new wrapping material.

A joining device for a strip-like material according to an embodiment of the present invention will be described hereinafter with reference to the accompanying drawings.

Figure 1:
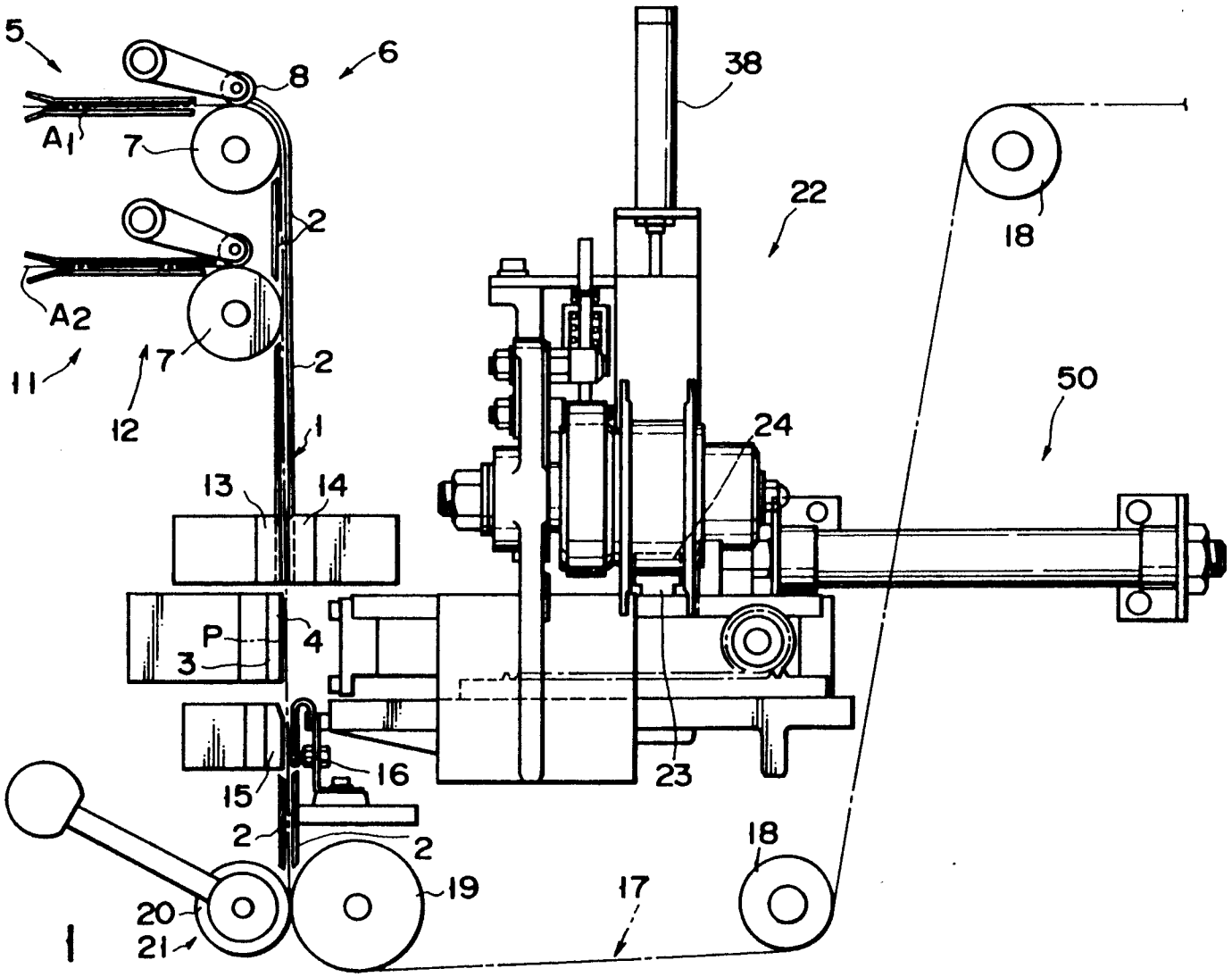
FIG. 1 is a side view of a joining device.

FIG. 1 shows a joining preparation path 1. The joining preparation path 1 extends in the vertical direction, and is mainly constituted by a plurality of pairs of guide plates 2 which oppose each other at predetermined intervals.

A stamper base 3 is arranged midway along the joining preparation path 1. The stamper base 3 has a flat receiving surface 4 extending along the joining preparation path 1 to oppose it. The central position on the receiving surface 4 is defined as a joining position P.

The upper end of the joining preparation path 1 is connected to a first guide path 5. FIG. 1 illustrates a portion of the first guide path 5. Although not shown, the upstream side of the first guide path 5 is connected to a first roll formed by winding a strip-like material, e.g., a first wrapping material Al. The first guide path 5 guides the first wrapping material A1 unrolled from the first roll to the joining preparation path 1.

As shown in FIG. 1, a first feed mechanism 6 for the wrapping material A1 is arranged at the terminal end of the first guide path 5, e.g., a connected portion between the first guide path 5 and the joining preparation path 1. The first feed mechanism 6 comprises a base feed roller 7 constituting a portion of the first guide path 5 and a pinch feed roller 8 which is in rolling contact with the base feed roller 7. The pinch feed roller 8 is attached to the distal end of a pivot arm 9. When the pivot arm 9 is pivoted, the pinch feed roller 8 can approach/separate from the base feed roller 7. In this embodiment, although the detailed structure is not shown, the pinch feed roller 8 is driven only when it is in rolling contact with the base feed roller 7.

The first feed mechanism 6 feeds the first wrapping material A1 from the first guide path 5 to the joining preparation path 1. The mechanism 6 can guide the leading end of the first wrapping material A1 to the stamper base 3 to be aligned with the joining position P. In order to precisely align the first wrapping material A1 with the joining position P, for example, a register mark (not shown) is printed on the first wrapping material A1 to be separated from its leading end at a predetermined interval, and a sensor 10 for detecting the register mark is arranged along the first guide path 5. The operation of the first feed mechanism 6 is controlled in accordance with the detection signal from the sensor 10. More specifically, a length from the leading end to the register mark of the first wrapping material A1 is set to be equal to a convey distance of the first wrapping material A1 between the sensor 10 and the joining position P. Therefore, when the sensor 10 detects the register mark, the operation of the first feed mechanism 6 can be stopped to align the leading end of the first wrapping material A1 with the joining position P.

A second guide path 11 is connected to the joining preparation path 1 to be located at a downstream side of the first guide path 5 and at an upstream side of the stamper base 3. A second feed mechanism 12 is arranged at a connecting portion between the second guide path 11 and the joining preparation path 1. The upstream side of the second guide path 11 is connected to a second roll formed by winding a second wrapping material A2. Since the second feed mechanism 12, and the like have the same structures as those of the first feed mechanism 6, and the like, the same reference numerals denote parts having the same functions as those described above, and a detailed description thereof will be omitted.

A pair of suction brake units 13 and 14 are arranged above the stamper base 3 to sandwich the joining preparation path 1 therebetween. One suction brake unit 15 is arranged below the stamper base 3. These suction brake units are connected to negative pressure sources, and can hold the corresponding first and second wrapping materials A1 and A2 guided to the joining preparation path 1 by suction. More specifically, when the leading end of the wrapping material A2 unrolled from the second roll is aligned with the joining position P, i.e., in a joining preparation state, the leading end portion is held by suction by the suction brake unit 13. Therefore, the leading end of the second wrapping material A2 can be prevented from being accidentally moved.

As shown in FIG. 1, the joining preparation path 1 is connected to a convey mechanism 21. The convey mechanism 21 comprises a guide path 17, extending from the lower end of the joining preparation path 1, for guiding one wrapping material toward the next process. The convey path 17 is defined by some guide rollers 18. On the convey path 17, a base feed roller 19 and a pinch feed roller 20 which are basically the same as the base feed roller 7 and the pinch feed roller 8 described above, are arranged to be located near the lower end of the joining preparation path 1. In this case, the rotational speed of the pinch feed roller 20 is variable. Therefore, if the first wrapping material A1 is assumed to be a wrapping material in use, the wrapping material A1 is unrolled beyond the joining position P of the joining preparation path 1. Then, the unrolling operation is taken over by the base feed roller 19 and the pinch feed roller 20, so that the wrapping material is fed toward the next process via the convey path 17.

A sensor 16 for detecting another register mark (not shown) printed on each of the first and second wrapping materials A1 and A2 is arranged below the suction brake unit 15 described above. The other register mark is printed at a position separated from the trailing end of each wrapping material by a predetermined length. When the sensor 16 detects the other register mark, travel of the wrapping material passing through the joining preparation path 1 can be stopped, so that the trailing end of this wrapping material can be aligned with the joining position P. That is, if the leading end of the second wrapping material A2 has been aligned with the joining position P, the trailing end can be aligned to mate with the leading end.

The trailing end of the wrapping material A can be easily aligned since the unrolling speed of the wrapping material can be varied by the base and pinch feed rollers 19 and 20. In this case, upon operation of the suction brake unit 15, the trailing end side of the wrapping material in use is held by suction.

When the trailing end of the first wrapping material A1 is aligned with the joining position P, a joining tape piece supply unit 22 shown in FIG. 1 is operated, and the trailing end of the first wrapping material in use and the leading end of the second wrapping material A2 in a joining preparation state are joined to each other by a joining tape piece by the joining tape supply unit 22.

Figure 2:
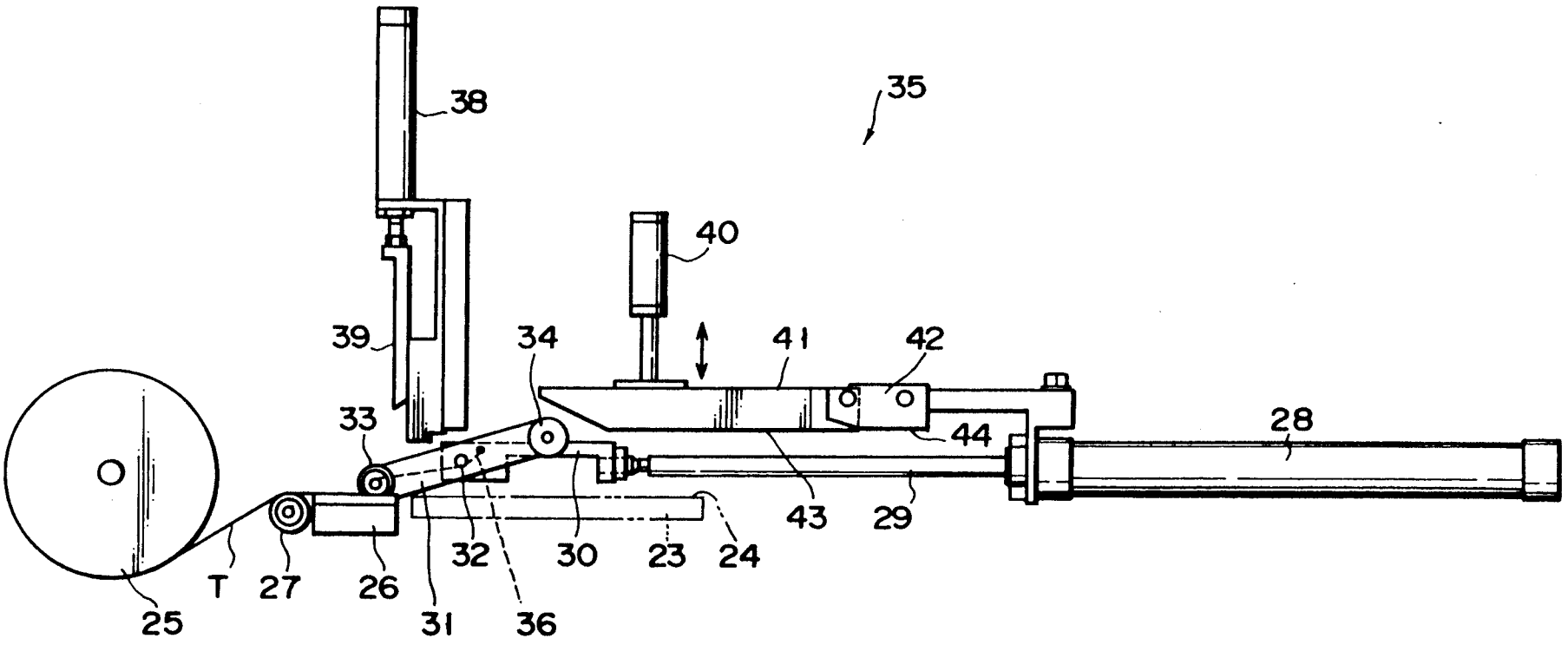
FIG. 2 is a partial schematic view of the joining device.

The joining tape supply unit 22 will be described below. The supply unit 22 comprises a stamper 23 for supplying a joining tape piece toward the stamper base 3, i.e., the joining position P although it is only schematically shown in FIG. 1. The stamper 23 can be selectively connected to a negative pressure source (not shown), and its upper surface facing up at its reset position serves as a suction surface 24. A joining tape piece is supplied to the suction surface 24. More specifically, the suction surface 24 extends in a direction perpendicular to the convey direction of the wrapping material, i.e., in a direction perpendicular to the drawing surface in FIG. 1. As schematically shown in FIG. 2, a tape reel 25 around which an adhesive tape T is wound is rotatably arranged near the end portion of the stamper 23. Rotation of the tape reel 25 is braked by a braking device (not shown). The adhesive tape T is unrolled from the tape reel 25 by a tape unrolling mechanism 35. The tape unrolling mechanism 35 will be described below. A suction base 26 connected to a negative pressure source (not shown) is arranged between the tape reel 25 and the stamper 23, and a guide roller 27 is arranged between the suction base 26 and the tape reel 25. The leading end portion of the adhesive tape T unrolled from the tape reel 25 via the guide roller 27 is held by suction by the suction base 26. The upper surface of the adhesive tape T on the suction base 26 serves as an adhesion surface.

An unrolling cylinder 28 comprising an air cylinder is arranged near the stamper 23 to be located on a side opposite to the tape reel 25. A piston rod 29 of the unrolling cylinder 28 extends to a position above the stamper 23, and a support bracket 30 is attached to the distal end of the piston rod 29. A central portion of a swing arm 31 is pivotally mounted on the support bracket 30 through a pin 32. An unrolling roller 33 with a ratchet is rotatably arranged on the distal end of the swing arm 31, and a guide roller 34 is rotatably mounted on the rear end thereof. The swing arm 31 is biased by a biasing spring 36 so that the unrolling roller 33 is located below the guide roller 34.

A cutter mechanism 37 is arranged above a position between the suction base 26 and the stamper 23. The cutter mechanism 37 comprises a cutter 39 which can be vertically moved by a lift cylinder 38. The cutter 39 has a function of cutting the joining tape T in cooperation with the suction base 26. Furthermore, a first guide 41 which is vertically movable by an air cylinder 40 is arranged above the stamper 23, and a second guide 42 is fixed to be located nearer the air cylinder 28 than the first guide 41. The lower surfaces of the first and second guides 41 and 42 are formed to serve as guide surfaces 43 and 4 interlocked with the guide roller 34, and the guide surfaces 43 and 44 partially overlap each other. As can be seen from the following description, the guide surfaces 43 and 44 have a function of swinging the swing arm 31 to vertically move the unrolling roller 33.

FIGS. 3 to 10 show a sequence for supplying the adhesive tape T from the suction base 27 to the stamper 23 in turn.

Figure 3:
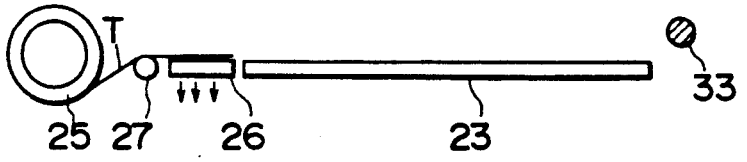
FIGS. 3 to 10 are schematic views sequentially showing operations of the mechanism shown in FIG. 2.
Figure 4:
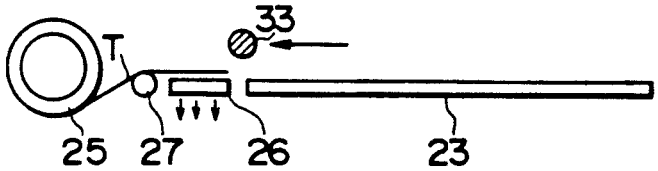
Figure 5:
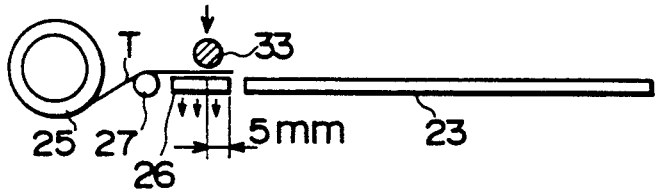

In a state illustrated in FIG. 3, the unrolling cylinder 28 is contracted, and hence, the unrolling roller 33 is located above the end portion of the stamper 23 opposite to the suction base 26. -At this time, since the first guide 41 is at a lower position shown in FIG. 2, the guide roller 34 is pressed downward by the guide surface 43 of the first guide 41. When the unrolling cylinder 28 is expanded in this state, the unrolling roller 33 is moved to a position above the suction base 26 while maintaining its upper position, as shown in FIG. 4, and is moved downward at a position separated by, e.g., 5 mm from the end of the suction base 26, as shown in FIG. 5, to be placed on the joining tape T on the suction base 26. The downward movement of the unrolling roller 33 can be attained since the guide roller 34 of the swing arm 31 reaches an inclined portion of the guide surface 43 of the first guide 41. Thereafter, the first guide 41 is moved upward to a predetermined position.

Figure 6:
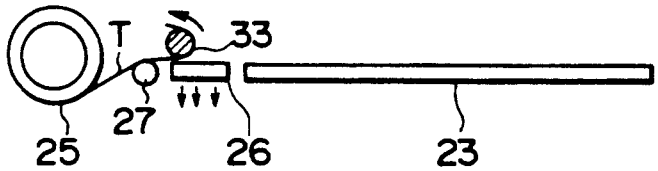

Thereafter, the unrolling roller 33 is moved while being in rolling contact with the joining tape T on the suction base 26, and winds the joining tape T therearound by a predetermined length, as shown in FIG. 6.

Figure 7:
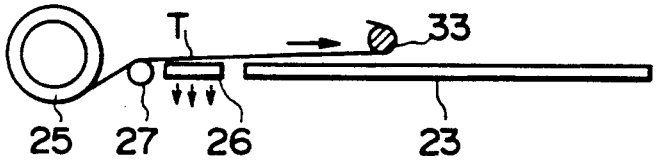
Figure 8:
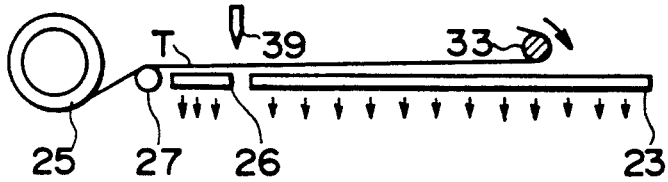

In this state, the unrolling roller 33 is returned while unrolling the joining tape T on the stamper 23, as shown in FIG. 7. In this case, the rotation of the unrolling roller 33 is kept stopped.

Figure 9:
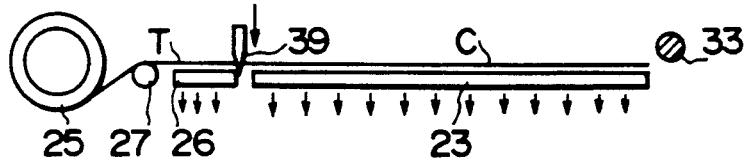
Figure 10:
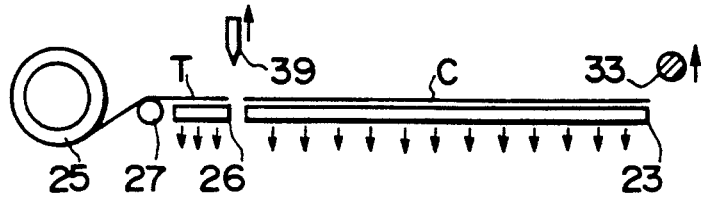

When the unrolling roller 33 is returned to a predetermined position above the stamper 23, the stamper 23 is connected to a negative pressure source to draw the adhesive tape T on the stamper 23 by suction, and at the same time, the ratchet of the unrolling roller 33 is released. Thus, the unrolling roller 33 is returned while being in rolling contact with the stamper 23 in a direction of an arrow in FIG. 8. Thus, a portion of the joining tape T wound around the unrolling roller 33 is unwound from the unrolling roller 33, and is drawn by suction on the stamper 23. In this state, the cutter 39 is moved downward to cut the joining tape T, as shown in FIG. 9. Thus, a joining tape piece C obtained by cutting the joining tape T is supplied on the stamper 23. Thereafter, as shown in FIG. 10, the cutter 39 is moved upward to a home position, and the unrolling roller 33 is moved upward since the guide roller 34 is operated by the second guide 42.

Figure 11:
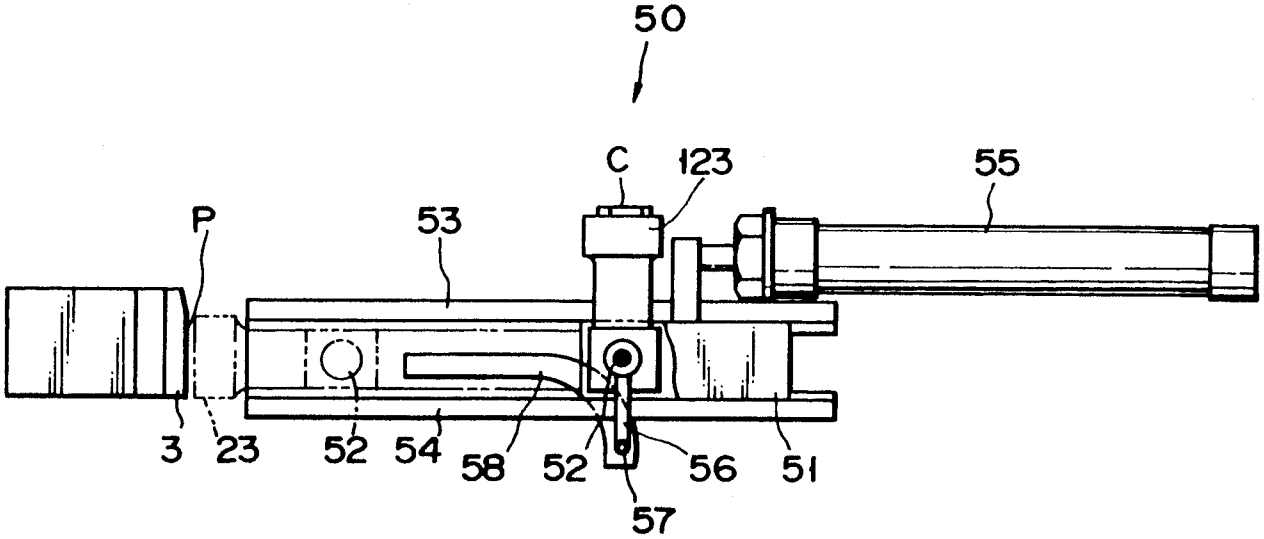
FIG. 11 is a partial view of the joining mechanism.

Supply of the joining tape piece C onto the stamper 23 is prepared in advance, and when the leading and trailing ends of the wrapping materials are mated with each other at the joining position P, the stamper 23 is moved toward the stamper base 3 by a stamper driving mechanism 50 shown in FIGS. 1 and 11 while holding the joining tape piece C by suction.

The stamper driving mechanism 50 comprises a carrier 51. A lower portion of the stamper 23 is mounted on the carrier 51 through a pivot shaft 52. The two ends of the pivot shaft 52 are rotatably supported by the carrier 51. The carrier 51 is guided along a pair of upper and lower guide rails 53 and 54 toward the stamper base 3. The carrier 51 is coupled to a piston rod of a pushing cylinder 55. Therefore, when the pushing cylinder 55 is expanded, the carrier 51, i.e., the stamper 23, is moved toward the stamper base 3.

Figure 12:
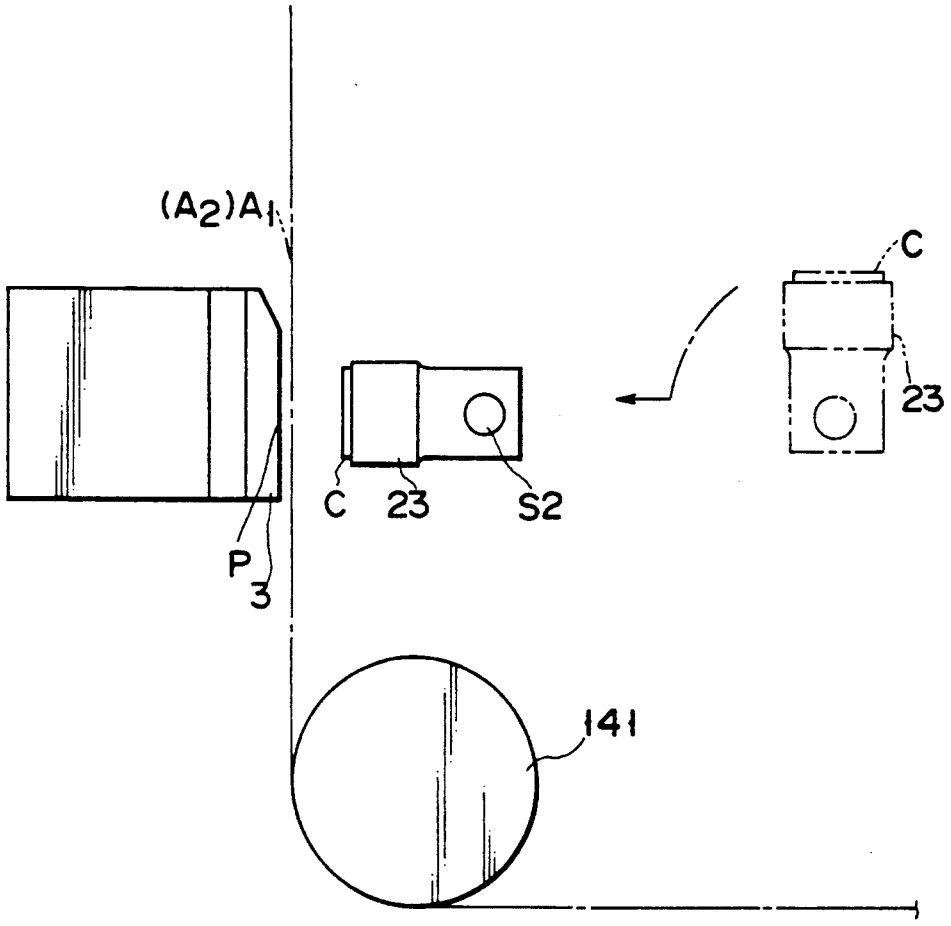
FIG. 12 is a schematic view showing an operation of the mechanism shown in FIG. 11.

An arm 56 which projects downward is arranged on the pivot shaft 52 of the stamper 23, as shown in FIG. 11. A cam follower 57 comprising a roller is attached to the lower end of the arm 56. The cam follower 57 is engaged with a cam groove 58. The cam groove 58 is formed to pivot the stamper 23 through 90° so that the adhesive tape C on the stamper 23 faces the stamper base 3 when the carrier 51 is moved toward the stamper base 3. FIG. 12 schematically shows movement of the stamper 23. As shown in FIG. 12, the stamper 23 which receives and holds the joining tape piece C on its suction surface 24 is rotated through 90°when it is moved toward the stamper, base 3. Therefore, the stamper 23 and joining tape piece C abut against the stamper base 3, and the trailing end of the first wrapping material A1 and the leading end of the second wrapping material A2 waiting at the joining position P can be joined to each other.

In this manner, after the first and second wrapping materials are joined to each other, the wrapping material is then unrolled from the second roll. Thus, a roll to be subjected to the unrolling operation of the wrapping material can be switched.

Thereafter, the first roll whose wrapping material is used up is replaced with a new first roll. The leading end of the first roll is guided to the joining position P and is set in a joining preparation state.

As described above, according to the joining device of the present invention, the trailing end of a strip-like material in use and the leading end of a strip-like material in a joining preparation state are mated and joined by a joining tape piece. Therefore, a joined portion between the strip-like materials which is wasted in the next process can be eliminated, and the strip-like material can be effectively used. In the joining device, since the strip-like materials can be joined at only one joining position, a mechanism for supplying a joining tape piece of the joining position can be simplified. In addition, since the suction surface of the stamper for holding the joining tape piece by suction faces up at a rest position, even if the overall operation of the joining device is stopped, and the suction surface loses its suction function, the joining tape piece can be prevented from falling off from this suction surface.

Additional advantages and modifications will readily occur to those skilled in the art. Therefore, the invention in its broader aspects is not limited to the specific details, representative devices, and illustrated examples shown and described. Accordingly, various modifications may be made without departing from the spirit or scope of the general inventive concept as defined by the appended claims and their equivalents.

What is claimed is:

1. A device for joining a leading end of a new strip-like material unrolled from one roll to a trailing end of a strip-like material unrolled and supplied from the other roll, comprising:

a joining preparation path for guiding a first strip-like material unrolled from a first roll and a second strip-like material unrolled from a second roll, so as to hold these materials in a vertical plane and vertically carry these materials downward;

a stamper base arranged midway along said joining preparation path and having a vertical flat receiving surface;

a first guide path coupled to an upstream end portion of said joining preparation path, the first strip-like material unrolled from said first roll being fed to said joining preparation path via said first guide path;

a second guide path coupled to said joining preparation path midway along said joining preparation path and at an upstream side position of said stamper base, the second strip-like material unrolled from said second roll being fed to said joining preparation path via said second guide path;

a first feed mechanism for conveying the first strip-like material fed from said first guide path to said joining preparation path to said stamper base, and aligning and holding the leading end of the first strip-like material at a predetermined position of the receiving surface of said stamper base;

a second feed mechanism for conveying the second strip-like material fed from said second guide path to said joining preparation path to said stamper base, and aligning and holding the leading end of the second strip-like material at a predetermined position of the receiving surface of said stamper base;

a conveying mechanism, arranged on a downstream end portion of said joining preparation path, for further conveying the first or second strip-like material fed through said stamper base;

joining tape supply means for supplying joining tape for joining the leading and trailing ends of the first and second strip-like materials;

wherein said joining tape supply means comprising a tape unrolling mechanism for unrolling the joining tape from a tape reel and supplying the unrolled joining tape in a horizontal direction;

a stamper having a suction surface adapted to receive the joining tape in a substantially face-up horizontal orientation, and to hold the joining tape by suction;

a stamper driving mechanism for driving said stamper toward the receiving surface of said stamper base, wherein said stamper driving mechanism is capable of moving said stamper toward or away from said receiving surface of said stamper base in a horizontal direction, said stamper driving mechanism driving said stamper such that, when said stamper is separate from said stamper base, said stamper is rotated until said suction surface becomes horizontal, and after the suction surface of said stamper receives a joining tape, said stamper is further rotated through 90° until said suction surface becomes vertical and said stamper is then moved in a direction such that said stamper approaches said stamper base; and a cutter mechanism for cutting the joining tape by a predetermined length to form a joining tape piece.

2. A device according to claim 1, wherein said stamper driving mechanism includes:

a carrier which is linearly movable in a horizontal direction and in which said stamper is rotatably arranged;

an actuator arranged for driving said carrier so that said carrier is moved toward or away from said stamper base; and cam means for rotating the stamper so that the suction surface of the stamper becomes horizontal when said carrier is separate from the stamper base, and for further rotating the stamper so that the suction surface of the stamper becomes vertical when said carrier is close to the stamper beam.

* * * * *